United States Patent [19]

Webster et al.

[11] 3,982,970

[45] Sept. 28, 1976

[54] DUCTILITY OF MOLYBDENUM AND ITS ALLOYS

[75] Inventors: Thomas Hutchinson Webster, Wantage; Brian Leonard Eyre, Abingdon, both of England

[73] Assignee: United Kingdom Atomic Energy Authority, London, England

[22] Filed: Aug. 27, 1974

[21] Appl. No.: 501,193

Related U.S. Application Data

[63] Continuation of Ser. No. 324,223, Jan. 16, 1973, abandoned.

[30] Foreign Application Priority Data

Jan. 24, 1972 United Kingdom ..... 3331/72

[52] U.S. Cl. ..... 148/20.3; 148/32; 148/133

[51] Int. Cl.[2] ..... C22F 1/18; C23C 11/10

[58] Field of Search ..... 148/20.3, 133, 31.5, 148/32; 75/174, 176

[56] References Cited

UNITED STATES PATENTS

| | | | |
|---|---|---|---|
| 3,161,949 | 12/1964 | Dickinson et al. | 148/20.3 |
| 3,163,563 | 12/1964 | Douglass et al. | 75/174 X |
| 3,205,099 | 9/1965 | Vordahl | 148/11.5 |
| 3,713,907 | 1/1973 | Van Thyne et al. | 148/31.5 |
| 3,772,096 | 11/1973 | Maguelin | 148/31.5 |

FOREIGN PATENTS OR APPLICATIONS

| | | | |
|---|---|---|---|
| 716,520 | 8/1965 | Canada | 75/174 |

OTHER PUBLICATIONS

Acta Metallurgica, vol. 15, Apr. 1967, Wilcox et al., pp. 601–606.

Acta Metallurgica, vol. 17, Aug., 1969, Evans et al., pp. 1109–1115.

Journal of the Less Common Metals, 2 (1960) pp. 392–398.

Trans. Met. Soc. of AIME, vol. 239, Dec. 1967, pp. 1949–1954.

*Primary Examiner*—C. Lovell

*Attorney, Agent, or Firm*—Larson, Taylor and Hinds

[57] ABSTRACT

The workability of a Group VIA metal, such as molybdenum, or an alloy of a Group VIA metal is improved by heat treating the Group VIA metal or alloy of the Group VIA metal in an environment for causing particles to be formed in the Group VIA metal or alloy of the Group VIA metal, and cooling the Group VIA metal or alloy of the Group VIA metal at a rate sufficiently rapid to prevent formation of particles large enough to cause embrittlement thereof. A ductile, recrystallized molybdenum or alloy thereof may thereby be produced.

3 Claims, No Drawings

DUCTILITY OF MOLYBDENUM AND ITS ALLOYS

This is a continuation of application Ser. No. 324,223 filed Jan. 16, 1973, now abandoned.

This invention relates to a method for improving the workability of a Group VIA metal or an alloy of a Group VIA metal.

Group VIA metals and alloys of Group VIA metals, such as molybdenum and its alloys, suffer from the disadvantage of tending to become weak and brittle after they have been recrystallised in a hydrogen atmosphere or in vacuo. They are then difficult to work effectively. Such recrystallisations may occur, for example, during annealing or during welding.

According to this invention, a method for improving the workability of a Group VIA metal or an alloy of a Group VIA metal comprises the steps of heat treating the Group VIA metal or alloy of a Group VIA metal in an environment for causing particles to be formed in the Group VIA metal or alloy of a Group VIA metal, and cooling the Group VIA metal or alloy of the Group VIA metal at a rate sufficiently rapid to prevent formation of particles large enough to cause embrittlement thereof.

By a Group VIA metal in this specification, we mean the metals chromium, molybdenum and tungsten of Group VIA of the Periodic Table. We particularly prefer that the Group VIA metal is molybdenum.

We have found that the present method gives rise to a Group VIA metal or alloy of a Group VIA metal having enhanced ductility compared with a Group VIA metal or an alloy of a Group VIA metal recrystallised in a hydrogen atmosphere or in vacuo. We believe that the improvement is due to the particles punching out dislocations in the vicinity of the grain boundaries of the Group VIA metal or alloy of the Group VIA metal and thus preventing large stress concentrations in these regions. We have also found that, in some cases, the strength of the Group VIA metal or alloy of the Group VIA metal is increased.

When the Group VIA metal is molybdenum, we prefer that the heat treatment takes place at a temperature in the range from 1800°C to 2050°C, preferably 1900°C. When the Group VIA metal is chromium, we prefer that the heat treatment takes place at a temperature in the range from 1300°C to 1500°C, preferably 1400°C. When the Group VIA metal is tungsten, we prefer that the heat treatment takes place at a temperature in the range from 2300°C to 2600°C, preferably 2500°C.

Preferably, the environment is a carburising environment which may contain, for example, a gaseous hydrocarbon, such as methane, for forming carbide particles by reaction with the Group VIA metal or alloy of the Group VIA metal. A large number of experiments have been carried out with a carburising atmosphere, for example, comprising methane. These experiments were carried out under a range of conditions of heat treatment. For example, experiments were carried out on molybdenum and its alloys at a temperature in the range from 1800°C to 2050°C and at a methane pressure of from 5 torr to 100 torr. The best results, in terms of the strength and ductility of the product, were obtained when the conditions of the heat treatment were a temperature of 1900°C and a pressure of 25 torr. Experiments were also carried out using very low methane pressures, i.e., in the range $10^{-5}$ to $10^{-3}$ torr, at a temperature of 1900°C. In these cases, the product had good ductility but relatively poor strength due to large grain size.

Other examples of environment which may be used in the present method are a nitriding environment, and an environment containing particles which are then formed in the Group VIA metal or alloy of Group VIA metal, for example, by the known techniques of powder technology. Examples of such particles are thoria or alumina. They are preferably less than 1 micron in size, and in any case, their size should be insufficient to cause embrittlement to the Group VIA metal or alloy of the Group VIA metal.

When the Group VIA metal or alloy of the Group VIA metal has not previously been recrystallised, the heat treatment is carried out at a temperature at which the Group VIA metal or alloy of the Group VIA metal is recrystallised. However, when the Group VIA metal or alloy of the Group VIA metal has been previously recrystallised, for example, in a hydrogen atmosphere or in vacuo, the heat treatment need not necessarily be carried out at a temperature at which the Group VIA metal or alloy of the Group VIA metal is recrystallised. The latter is particularly useful in ductilising existing welds of Group VIA metals or alloys of Group VIA metals.

Control of the rate at which the cooling takes place is important in the present method, since this affects the size of particles formed. If the particle size is too large, the Group VIA metal or alloy of the Group VIA metal may be embrittled. Generally, we have found that the more rapid the cooling, the smaller are the particles formed and the less brittle is the product. In one example, the alloy TZM, which is an alloy of molybdenum and whose detailed composition is given in the examples herein, was heat treated at a temperature of 1900°C in an atmosphere of 25 torr methane. When it was cooled at a rate of 50°C/minute immediately after this heat treatment, a brittle product resulted; when it was cooled at a rate of 200°C/minute immediately after this heat treatment, a ductile product resulted. This is why the cooling rate should be sufficiently rapid to prevent formation of particles large enough to cause embrittlement of the Group VIA metal or alloy of the Group VIA metal. Preferably, the cooling rate is at least 100°C/minute and it is particularly preferred that the cooling rate is 250°C/minute. The rapid cooling rate is only necessary immediately following the heat treatment. For example, in the case of molybdenum or an alloy thereof which has been heat treated at 1900°C, it is only necessary to cool rapidly to about 800°C. The rate of further cooling is unimportant. A required cooling rate may be obtained, for example, by use of techniques known in the art, for example, quenching techniques.

The present invention has a number of important applications. For example, wrought molybdenum and molybdenum alloy products are currently made by an expensive work/stress-relieve technique. This invention makes possible the production of a ductile, recrystallised molybdenum or alloy thereof, which may be workable by a work/recrystallise process. This gives rise to attendant reductions in working power, working temperature and tool wear. Also, the invention may be used to produce ductile welds in molybdenum and alloys thereof, and in the ductilisation of existing welds, which was mentioned previously.

The invention will now be illustrated by the following examples of tests carried out on a 0.020 inch sheet of arc-cast Climelt TZM alloy on initial composition Ti 0.42, Zr 0.087, C 0.016, O<0.003, H<0.0001, N<0.0003, Fe<0.0001, Ni<0.001, Si<0.002 w/o, balance Mo. Tensile specimens were prepared from the sheet and polished in a 25% solution of sulphuric acid in methanol.

In each case, a specimen was heated in a furnace for 1 hour, cooled by withdrawal from the hot zone, polished and tensile tested at room temperature using an Instron Universal Testng Machine operating at an initial strain rate of $7 \times 10^{-3}$ $min^{-1}$. The results obtained are summarised in Table I. Examples 1 to 10 were carried out in vacuo and Examples 11 to 17 in a carburising environment.

The effect of the application of the method to specimens previously embrittled by recrystallisation is illustrated in Table II. A doubling of the ductility is obtained by carburising.

Similar experiments were carried out using molybdenum itself. The results are summarised in Table III, where Examples 18 and 19 apply to a coarse grain size molybdenum and Examples 20 and 21 to a fine grain size molybdenum. In each case the heat treatment was for 1 hour, and the molybdenum was cooled by withdrawing it from the furnace.

TABLE I

| Specimen | Treatment Conditions | Grain Size (μ) | 0.2% Proof Stress (kg/mm²) | 0.2% Proof Stress (p.s.i.) | U.T.S. (kg/mm²) | U.T.S. (p.s.i.) | Reduction of Area (%) | Elongation at Fracture* (cm × 10²) |
|---|---|---|---|---|---|---|---|---|
| 1 | Recrystallised 1 hr in vacuum of ~2 × 10⁻⁵ torr at 1800°C. | 96 | 26.7 | 37,970 | 44.0 | 62,570 | 8.1 | 9.1 |
| 2 | | | 26.4 | 37,540 | 43.0 | 61,150 | 8.4 | 8.1 |
| 3 | Recrystalised 1 hr in vacuum of ~2 × 10⁻⁵ torr at 1815°C. | 122 | 26.1 | 37,110 | 41.4 | 58,870 | 5.6 | 2.8 |
| 4 | | | 27.1 | 38,540 | 38.6 | 54,890 | 1.5 | 3.6 |
| 5 | Recrystallised 1 hr in vacuum of ~2 × 10⁻⁵ torr at 1900°C. | 167 | 28.6 | 40,670 | 30.1 | 42,800 | 1.6 | 0.5 |
| 6 | | | 27.7 | 39,390 | 40.5 | 57,590 | 5.3 | 5.2 |
| 7 | Recrystallised 1 hr in vacuum of ~2 × 10⁻⁵ torr at 2000°C. | 203 | 26.9 | 38,250 | 40.8 | 58,020 | 6.8 | 7.0 |
| 8 | | | 25.6 | 36,400 | 28.5 | 40,530 | 2.7 | 0.5 |
| 9 | | | 25.8 | 36,690 | 40.8 | 58,020 | 10.2 | 8.1 |
| 10 | Recrystallised 1 hr in vacuum of ~2 × 10⁻⁵ torr at 2050°C. | 234 | 23.2 | 32,990 | 34.7 | 49,340 | 3.8 | 2.8 |
| 11 | Coarse-grained ductile TZM | 253 | 26.0 | 36,970 | 40.1 | 57,020 | 26.0 | 19.5 |
| 12 | 1 hr in vacuum of 2 × 10⁻⁵ torr containing free carbon at 1900°C. | | 25.3 | 35,980 | 39.6 | 56,310 | 36.0 | 22.0 |
| 13 | Fine-grained ductile TZM | 40 | 31.3 | 44,510 | 58.2 | 82,760 | 12.1 | 15.1 |
| 14 | Batch A. 1 hr at 1900°C in 25 torr methane. | | 31.6 | 44,340 | 59.9 | 85,180 | 21.3 | 27.0 |
| 15 | Batch B. As above. | 39 | 30.4 | 43,230 | 55.2 | 78,490 | 15.9 | 12.4 |
| 16 | Batch C. As above. | 35 | 31.6 | 44,940 | 57.2 | 81,340 | 14.0 | 14.0 |
| 17 | | | 32.2 | 45,790 | 56.1 | 79,770 | 33.4 | 25.6 |

*Nominal gauge length = 1.5 cm.

TABLE II

| Treatment Conditions | Grain Size (μ) | 0.2% Proof Stress (kg/mm²) | 0.2% Proof Stress (p.s.i.) | U.T.S. (kg/mm²) | U.T.S. (p.s.i.) | Reduction in Area (%) | Elongation at Fracture (cm × 10²) |
|---|---|---|---|---|---|---|---|
| Recrystallised 1 hr at 2000°C in vacuum of ~× 10⁻⁵ torr. | 203 | 26.1* | 37,110* | 36.7* | 52,190* | 6.6* | 5.2* |
| As above + carburised by annealing for 1 hr in dynamic vacuum of ~2 × 10⁻⁵ torr containing free carbon at 1905°C and then for 1 hr at 1905°C in 5 × 10⁻³ torr methane. | 199 | 29.5 | 41,950 | 46.6 | 66,270 | 13.3 | 14.0 |

'Nominal gauge length = 1.5 cm.
*Average of three specimens

TABLE III

| Example | Treatment Conditions | 0.2% Proof Stress (p.s.i.) | Ultimate Tensile Strength (p.s.i.) | Reduction of Area (%) | Elongation at fracture (%) |
|---|---|---|---|---|---|
| 13 | 1950°C in vacuo | 25,450 | 37,540 | 19.3 | 21.8 |
| 14 | 1900°C in vacuo | 28,440 | 37,680 | 94.5 | 50.1 |

TABLE III-continued

| Example | Treatment Conditions | 0.2% Proof Stress (p.s.i.) | Ultimate Tensile Strength (p.s.i.) | Reduction of Area (%) | Elongation at fracture (%) |
|---|---|---|---|---|---|
| | cont. free carbon | | | | |
| 15 | 1850°C in vacuo | 43,090 | 62,570 | 52.6 | 37.3 |
| 16 | 1900°C in vacuo cont. free carbon | 47,490 | 61,290 | 53.4 | 41.6 |

The results obtained clearly show that the ductility of TZM and molybdenum is enhanced by the method of this invention, compared with recrystallisation in vacuo, and that, in certain cases, the strength of the TZM and the molybdenum is enhanced. They also show that TZM, which has been previously embrittled by recrystallisation in vacuo, may be ductilised by the method of this invention.

We claim:

1. A method for improving the workability of molybdenum or a base alloy thereof which comprises the steps of i. gas carburising the molybdenum or base alloy thereof at a temperature within the range from 1800°C to 2050°C to produce a carbide therein; and ii. cooling the gas carburised molybdenum or base alloy thereof, wherein the rate of cooling immediately following the carburisation and down to 800°C is at at least 100°C/minute, thereby to produce carbide particles.

2. A method according to claim 1 wherein step (i) takes place in an atmosphere of methane.

3. A method according to claim 2 wherein the methane pressure is in the range from 5 torr to 100 torr.

* * * * *